United States Patent [19]

Smith, Jr.

[11] 3,988,201

[45] Oct. 26, 1976

[54] SYSTEM FOR HEATING DRYERS AND GENERATING STEAM IN PAPERMAKING INSTALLATIONS

[75] Inventor: Horace L. Smith, Jr., Richmond, Va.

[73] Assignee: Smitherm Industries, Inc., Richmond, Va.

[22] Filed: Jan. 20, 1976

[21] Appl. No.: 650,778

Related U.S. Application Data

[63] Continuation-in-part of Ser. No. 622,617, Oct. 15, 1975.

[52] U.S. Cl. ..... 162/290; 34/119; 162/359; 165/47

[51] Int. Cl.[2] ..... D21F 5/06

[58] Field of Search ..... 162/206, 207, 290, 359; 34/41, 119, 124, 125, 152, DIG. 20; 165/47, 89, 90

[56] References Cited

UNITED STATES PATENTS

| | | | |
|---|---|---|---|
| 2,811,787 | 11/1957 | Clements | 162/290 X |
| 3,236,292 | 2/1966 | Smith, Jr. | 165/103 X |

*Primary Examiner*—S. Leon Bashore
*Assistant Examiner*—Richard V. Fisher
*Attorney, Agent, or Firm*—Strauch, Nolan, Neale, Nies & Kurz

[57] ABSTRACT

Installations and methods for making paper in which high boiling point liquids are employed to heat the dryers in a dryer section and to generate process and/or power steam.

7 Claims, 2 Drawing Figures

SYSTEM FOR HEATING DRYERS AND GENERATING STEAM IN PAPERMAKING INSTALLATIONS

PAPERMAKING INSTALLATIONS AND METHODS (II)

Figure 1:
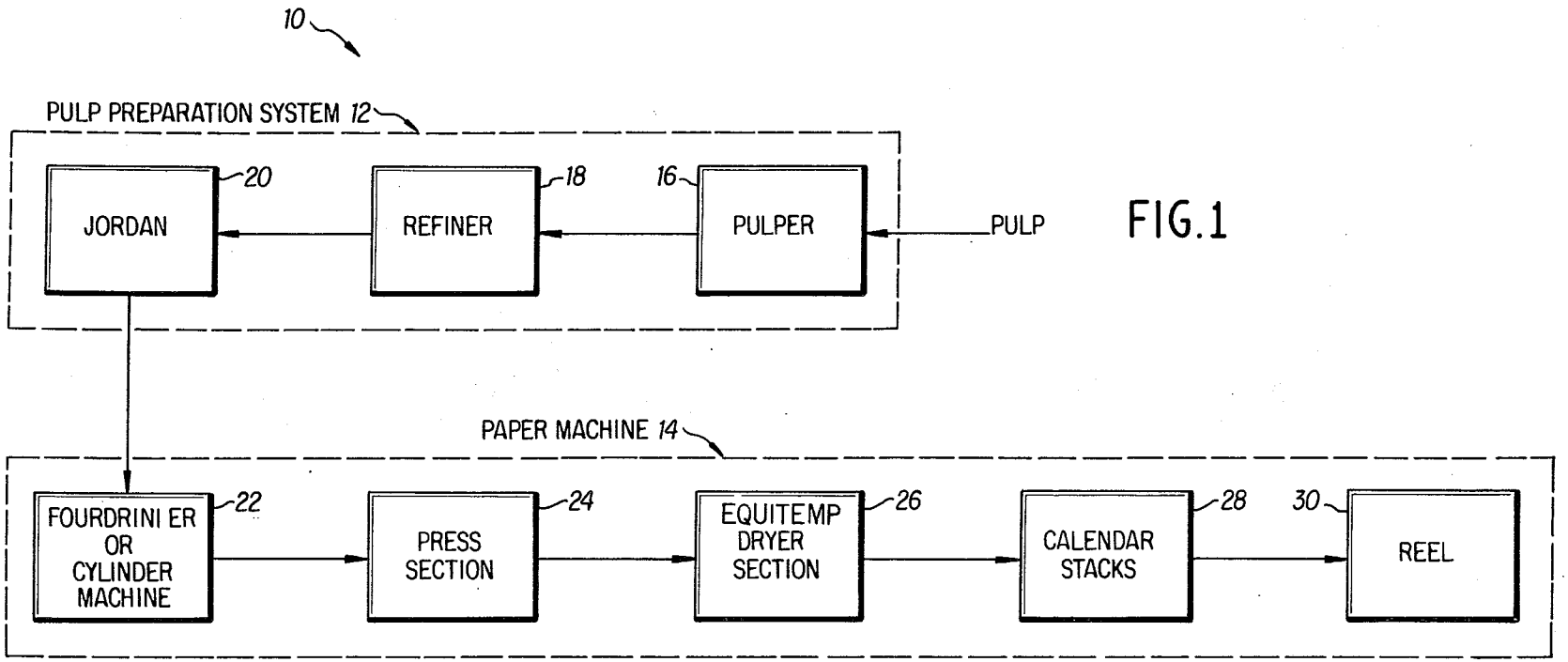

This application is a continuation-in-part of application no. 622,617 filed Oct. 15, 1975.

The present invention relates to papermaking and, more particularly, to novel, improved methods and apparatus for supplying heat to the dryer section of a paper machine and for also generating process and/or power steam for the papermaking operation.

The term "paper" is used herein in the same generic sense as it is in the papermaking industry. Products embraced by this term include: newsprint; uncoated, ground wood paper; coated printing and converting papers; uncoated book paper; writing and related papers; bleached bristols; unbleached kraft packaging and industrial converting papers; other packaging and industrial converting papers; special industrial papers; tissue paper; unbleached kraft and industrial converting paperboard; bleached packaging and industrial converting paperboard; semichemical paperboard; combination furnish paperboard; wet machine board; and contruction paper and board.

In parent application no. 622,617 I disclosed certain novel dryer sections for papermaking machines in which the heat for operating the dryers is supplied by a high boiling point, heat transfer liquid rather than the conventional saturated steam. This provides a number of advantages including a substantial reduction in the cost of making paper.

I have now discovered that, in many cases, even further cost reductions can be obtained by also employing the heat transfer liquid in generating part or all of the power and/or process steam for the papermaking installation. This novel technique of generating the requisite steam is particularly useful in mills where the pulp is supplied from an outside source and steam requirements are more modest than if all the pulp is made at the mill.

One or more conventional, shell and tube type heat exchangers can be employed as steam generators in systems employing the principles of the present invention. Such devices are efficient, relatively inexpensive, and comparitively easily serviced and maintained.

When required or advantageous, superheat can be added to the steam by locating a superheater section in the heating unit for the heat transfer liquid. Also, a feedwater heater operated by the heat transfer liquid can be provided to heat the water supplied to the steam generator and make the operation even more efficient in many cases. The feedwater heater can also be relied on to meet the hot water requirements of the installation.

A variety of heat exchange liquids which can be used in systems employing the principles of the present invention are available. Among these are Therminol heat transfer fluids, proprietary products of Monsanto Chemical Company, which may be used at tamperatures as high as 800° F. Other suitable heat transfer liquids are marketed by the Dow Chemical Company under the name Dowtherm and by Chemische Werke Hüls AG under the name Marlotherm.

From the foregoing it will be apparent to the reader that one important object of the present invention resides in the provision of novel, improved papermaking installations in which the product(s) can be more inexpensively produced.

Another important and primary object of the invention resides in the provision of novel, improved systems for supplying steam or steam and hot water in papermaking installations.

A related and also important object of the invention is the provision of systems as aforesaid in which a high boiling point heat transfer liquid used to supply heat to a dryer section or sections is also employed to generate the steam or steam and hot water.

Yet another important object of the invention resides in the provision of systems as aforesaid which are efficient and comparatively inexpensive to provide, service, and maintan.

Figure 2:
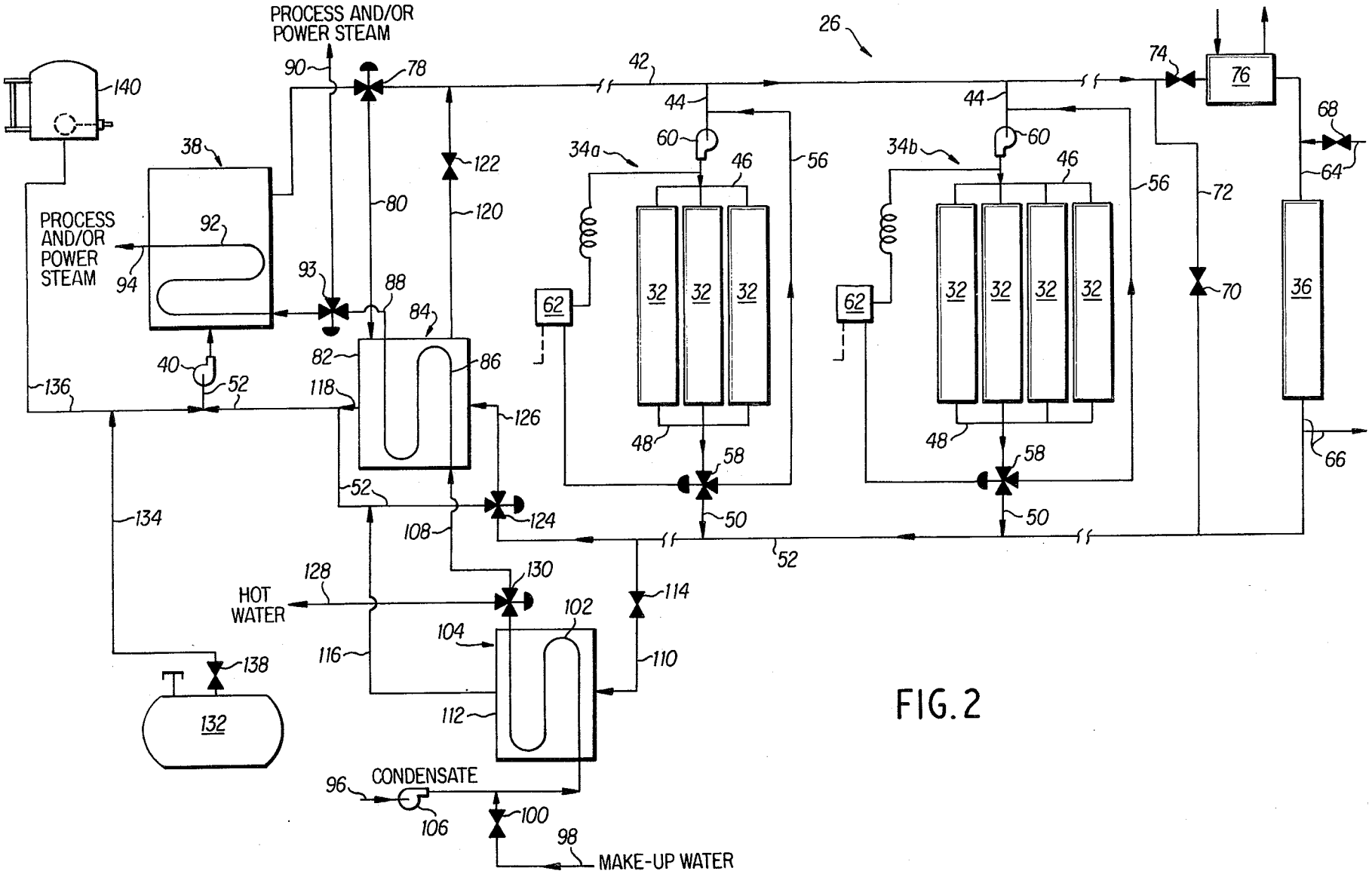

Other objects and features and additional advantages of the present invention will be apparent from the appended claims and as the ensuing detailed description and discussion proceeds in conjunction with the accompanying drawing in which:

FIG. 1 shows in block diagram form certain major commponents and units of papermaking mill of the present invention; and FIG. 2 is a schematic illustration of a system in accord with the present invention for supplying heat to the dryer section of the mill and for generating part or all of the process and/or power steam for the mill.

Referring now to the drawing, many paper manufacturers operate facilities in which part or all of the pulp is obtained from an outside source. If a papermaking facility of this character is provided with a liquid heated dryer section in accord with the principles set forth in parent application no. 622,617, the demand for steam and hot water will become relatively modest. The bulk of these fluids are consumed in making the pulp (see companion application no. 650,780 filed Jan. 20, 1976 and in operating the dryer section of a conventional paper machine, which is heated by steam (see parent application no. 622,617). In these circumstances significant operating economies can be obtained by omitting the steam generator customarily employed and using a heat exchanger operated by the heat transfer liquid to generate such steam and hot water as may be required.

A papermaking facility of the character just described is illustrated diagrammatically in FIG. 1 and identified by reference character 10.

Papermaking facility 10 includes a stock preparation system 12 and a paper machine 14. The stock preparation system, which is conventional, includes a pulper 16 for disintegrating pulp or broke and suspending the fibers in water and a refiner 18 and a Jordan 20 for mechanically making the fibers suitable for forming into a sheet or web of paper. Typically, provision will also be made for adding various chamicals and fillers to the stock.

From preparation system 12 the stock flows to paper machine 14 which includes a Fourdrinier, cylinder, or other machine 22 for forming the fibers supplied from stock preparation system 12 into a sheet or web. In a modern machine the sheet may be 30 feet wide or wider, and it may be formed at a rate of 5,000 feet per minute or higher.

The stock then proceeds through a press section 24 where the wet web (which may be up to 85 percent water) is squeezed and/or subjected to a vacuum to remove as much water as practical as mechanical removal is much less costly than removing the water by evaporation.

From press secton 24 the paper (now having a moisture content of one to three pounds per pound of paper) passes through a dryer section 26 in accord with the principles of the present invention where the web is dried to a moisture content of 6 to 10 percent; i.e., to a moisture content of 0.1 pound per pound of paper or less.

The dried web is passed through calendar stacks 28 to improve the quality of the paper by compacting it and by smoothing and otherwise changing its surface properties through pressure and friction.

After passing through the calendar stacks, the paper is wound into a roll by a reel 30, completing the manufacturing process except for trimming the edges of the web, slitting the paper into strips of a selected width, and rewinding the strips.

Turning now to FIG. 2, dryer section 26 includes liquid heated, rotary dryers 32 divided into groups in which the operating temperatures can be independently controlled to optimize the drying operation (two such groups are shown in FIG. 2 and identified by reference characters 34*a* and 34*b*).

Dryer section 26 also has a sweat roll 36 for adjusting the surface moisture content of the paper to the optimum level for calendaring in calendar stacks 28.

Paper dryers 32 and sweat roll 36 are of the equitemp type and, preferably, of a construction shown in parent application no. 622,617 or in my prior U.S. Pat. Nos. 3,177,932 issued Apr. 13, 1965, for DRUM TYPE HEAT TRANSFER APPARATUS; 3,181,605 issued May 4, 1965, for UNIFORMLY HEATED ROTARY DRUM; and 3,228,462 issued Jan. 11, 1966, for HEAT EXCHANGE APPARATUS, which are hereby incorporated herein by reference.

Equitemp rotary dryers have concentric inner and outer shells between which a heat exchange liquid is circulated to heat the outer shell. Typically, the heat exchange liquid is circulated in counterflow fashion through internested, labyrinthic flow channels defined by partitions between the inner and outer shells.

The heat transfer liquid for dryers 32 is heated in a unit shown in block diagram form and identified by reference character 38. A number of suitable units have heretofore been proposed. One is disclosed in my prior U.S. Pat. No. 3,236,292 issued Feb. 22, 1966, for HIGH TEMPERATURE HEATING APPARATUS, hereby incorporated by reference herein.

A pump 40 circulates the heated liquid through main supply conduit 42, branch conduits 44, and supply manifold 46 to the dryers 32 in dryer section 26. After flowing through the dryers, the liquid is discharged through manifold 48 into branch conduits 50 and is recirculated through these and main return conduit 52 to heating unit 38.

One of the advantages of the illustrated dryer section is that the different groups of dryers can be maintained at different temperatures. For example, the three paper dryers 32 in the first dryer group or zone 34*a* will typically be operated at temperatures comparable to those of the dryers in a conventional installation. Otherwise, moisture may be evaporated at such a high rate as to blow the paper away from the dryers.

The remaining paper dryers 32 will, however, typically be operated at temperatures as such as 250°F or more above the practical maximum of steam heated, rotary dryers. The result is a significant increase in efficiency and a corresponding reduction in cost.

Independent control over the different groups or zones is furnished by a recirculation conduit 56 connected between the branch return and supply conduits 50 and 44 in each zone and a three-way diverting valve 58 discharging into conduits 50 and 56.

A pump 60 in each dryer group or zone 34 circulates the liquid through the dryers and conduits in that zone.

The valve 58 in each zone is controlled by a conventional, temperature responsive controller 62. The controller has a sensor (not shown) that responds to the temperature of the liquid circulated to the paper dryers by pump 60.

If the dryers in a particular group become too hot, the controller 62 for that group adjusts its valve 58 to divert relatively cool liquid through recirculation conduit 56 to the inlet side of pump 60. Recirculation continues until the temperature of the dryers drops to the wanted level. Then temperature controller 62 repositions valve 58, decreasing the flow of liquid through recirculation conduit 56 and increasing the flow through branch return conduit 50. As a result, increased quantities of more highly heated heat transfer liquid are pumped from main supply conduit 42 through branch supply conduit 44 and into the dryers.

As indicated above, the novel dryer section 26 of the present invention will typically include a sweat roll 36 which may be of the same construction as the paper dryers 32. Typically, water from any convenient source will be employed as an operating liquid for the sweat dryer. As shown in FIG. 2, the water can be supplied to the sweat dryer through conduits 64 and then discharged from the sweat roll through conduits 66.

Alternatively, the same heat transfer liquid employed to operate the dryers may be used as the operating liquid for the sweat roll. In this case, valve 68 in the water supply line is closed as is valve 70 in a bypass conduit 72 between main heat transfer liquid supply and return lines 42 and 52. Valve 74 in conduit 42 is then opened permitting the heat transfer liquid to flow through a conventional heat exchanger 76 of the shell and tube or other appropriate type to reduce the temperature of the heat transfer liquid. From the cooler the liquid flows sequentially through conduit 64, the sweat roll, and conduit 66 into main return conduit 52.

Referring still to FIG. 2, steam for papermaking facility 10 is generated by diverting heat transfer liquid from main supply conduit 42 through a proportioning valve 78 and a branch supply conduit 80 into the shell side 82 of a shell and tube type heat exchanger or steam generator 84 and by circulating water through the tube side 86 of the heat exchanger.

The steam can be taken off through lines 88 and [illegible]. Alternatively, all or part of the steam can be fed through line 88 into a superheater 92 located in the heat transfer liquid heating unit 38 to increase the temperature of the steam by adjusting proportioning valve 93. This steam is then delivered to the process and/or power units in which it is employed through a supply conduit system identified generally by reference character 94.

Typically, the feedwater introduced into the tube side of heat exchanger 84 is condensate returned from various using units through line 96. Make-up water is added to the condensate through a supply line 98 at a rate controlled by valve 100.

The feedwater may be supplied directly to the heat exchanger. Typically, however, it will first be circulated through the tube side 102 of a feedwater heater 104 by a feedwater pump 106 to increase its temperature and then delivered through a conduit 108 to steam generator 84.

The water is heated in feedwater heater 104 by heat transfer liquid diverted from main return conduit 52 through line 110 to the shell side 112 of the feedwater heater at a rate determined by the setting of valve 114. From the shell side of the feedwater heater, the heat transfer liquid flows through line 116 back into main return conduit 52.

As shown in FIG. 2, the heat transfer liquid discharged from steam generator 84 may also be returned to conduit 52, in this case through a branch discharge conduit 118. Alternatively, depending upon the temperature of the liquid, it may be discharged through conduit 120 and valve 122 into and mixed with the liquid in main heat transfer liquid supply conduit 42.

FIG. 2 also shows that the heat transfer liquid need not necessarily be supplied to steam generator 84 from main supply conduit 42. Instead, or in addition, heat transfer liquid flowing back to heating unit 38 through main return conduit 52 can be diverted from the latter through proportioning valve 124 and conduit 126 into the steam generator.

Hot water requirements for plant 10 can be met by diverting water discharged from feedwater heater 104 into hot water supply conduit 128. Valve 130 proportions the flow of water between the hot water supply line 128 and the feedwater line 108.

In addition to the components described above, the heat transfer liquid circulation system will typically include a storage tank 132 from which liquid can be supplied as necessary to the system through conduits 134 and 136 at a rate controlled by valve 138. Also, when servicing or maintenance of the units through which the liquid circulates is necessary, the liquid can be pumped back into storage tank 132.

An expansion tank 140 is connected into the heat transfer liquid circulation system through conduit 136. Tank 140 accommodates expansion of the liquid in the closed system, preventing abnormal pressure conditions from bursting conduits or other system components, and also maintains a gravity head on the system.

Other components will also typically be included to regulate the temperature, rate-of-flow, and/or other parameters of the heat transfer liquid. The more important and less obvious of these are described in U.S. Pat. No. 3,236,292 referred to above.

Simiarly, the dryer section 26 itself will include a number of major components in addition to those described briefly above in illustrating the nature of the present invention. To the extent that these components are of major importance and not of a conventional nature, they are described in parent application no. 622,617.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A papermaking installation including: means for forming pulp into a web; means for drying the web comprising at least one dryer having an external surface over which the web can be passed to transfer heat from said dryer to said web and at least one circuit through which a heat transfer liquid can be circulated to raise the temperature of said surface; heat exchange means through which the liquid can be circulated; means for circulating the liquid through the dryer and through the heat exchange means; and means for circulating an aqueous fluid through said heat exchange means in heat transfer relationship with the liquid to generate steam for the installation.

2. A papermaking installation according to claim 1, together with means for heating the heat transfer liquid, said means including means for superheating the steam generated by circulating the heat transfer liquid through said heat exchange means.

3. A papermaking installation according to claim 1, wherein the means for drying the web comprises a plurality of rotary dryers adapted to have the web wrapped seriatim therearound to thereby bring said web into heat transfer relationship with the dryers.

4. A papermaking installation including means for forming pulp into a web; means for drying the web comprising at least one dryer having an external surface over which the web can be passed to transfer heat from said dryer to said web and at least one circuit through which a heat transfer liquid can be circulated to raise the temperature of said surface; means for heating the heat transfer liquid; a first conduit means through which heat transfer liquid can be circulated to said dryer and a second conduit means through which said liquid can be returned to said heating means after circulating through the dryer; means for circulating the liquid from said heating means seriatim through said first conduit, said dryer, and said second conduit; a heat exchanger; means for circulating an aqueous fluid through said heat exchanger; and means selectively operable to divert heat transfer liquid from said first conduit means through said heat exchanger in heat transfer relationship with said aqueous fluid to heat said aqueous medium and thereby provide steam for the installaton.

5. The installation of claim 4, together with a feedwater heater in series with and upstream from said heat exchanger and means for diverting heat transfer liquid through said feedwater heater to heat the aqueous fluid before it advances to said heat exchanger.

6. The installation of claim 4, together with means selectively operable to also divert heat transfer liquid from said second conduit means through said heat exchanger in heat transfer relationship with the aqueous fluid.

7. A papermaking installation including means for foming pulp into a web; means for drying the web comprising at least one dryer having an external surface over which the web can be passed to transfer heat from said dryer to said web and at least one circuit through which a heat transfer liquid can be circulated to raise the temperature of said surface; means for heating the heat transfer liquid; a first conduit means through which heat transfer liquid can be circulated to said dryer and a second conduit means through which said liquid can be returned to said heating means after circulating through the dryer; means for circulating the liquid from said heating means seriatim through said first conduit, said dryer, and said second conduit; a heat exchanger; means for circulating an aqueous fluid through said heat exchanger; and means selectively operable to divert heat transfer liquid from said second conduit means through said heat exchanger in heat transfer relationship with said aqueous fluid to heat said aqueous medium and thereby provide steam for the installation.

* * * * *